US005901382A

United States Patent [19]

Chiang

[11] Patent Number: 5,901,382

[45] Date of Patent: May 11, 1999

[54] SWIMMING GOGGLES

[76] Inventor: Herman Chiang, 11F-2, No. 634-9, Ching-Ping Road, Chung-Ho, Taipei Hsien, Taiwan

[21] Appl. No.: 08/988,298

[22] Filed: Dec. 10, 1997

Related U.S. Application Data

[62] Division of application No. 08/621,953, Mar. 26, 1996, Pat. No. 5,734,995.

[51] Int. Cl.[6] ..... A61F 9/02

[52] U.S. Cl. ..... 2/445; 2/440; 2/439

[58] Field of Search ..... 2/426, 428, 439, 2/440, 441, 442, 445, 446, 452, 443; 351/43

[56] References Cited

U.S. PATENT DOCUMENTS

| | | | |
|---|---|---|---|
| 2,881,444 | 4/1959 | Fresh et al. | 2/428 |
| 5,524,300 | 6/1996 | Chiang | 2/439 |
| 5,546,611 | 8/1996 | Lathrop | 2/428 |
| 5,734,995 | 4/1998 | Chiang | 2/445 |

*Primary Examiner*—John J. Calvert

*Assistant Examiner*—Larry D. Worrell, Jr.

*Attorney, Agent, or Firm*—Pro-Techtor International Services

[57] ABSTRACT

A pair of swimming goggles include two lens frames, two lens units, a nose bridge, two gasket units and a head strap. Each of the lens frames has an inner periphery that defines a lens retaining space, and an outer periphery that has bridge and strap connecting portions. Each of the lens units is mounted on a front part of a respective one of the lens frames in the lens retaining space of the latter. Each of the two terminal end portions of the nose bridge is connected to the bridge connecting portion of the respective lens frame. The gasket units are provided on rear parts of the respective lens frames. The head strap has two ends connected respectively to the lens frames. The lens frames, the nose bridge and the gasket units are formed integrally. The strap connecting portion of each of the lens frames is formed integrally with an elongated extension which is connected to one of the ends of the head strap and which is formed with at least one depression to enhance stretchability of the extension, thereby reducing the amount of pulling force that is transmitted to the lens frames by the head strap when the swimming goggles are in use.

1 Claim, 9 Drawing Sheets

SWIMMING GOGGLES

CROSS REFERENCE OF RELTAED APPLICATION

This application is a divisional application of U.S. patent application Ser. No. 08/621,953 U.S. Pat. No. 5734995 filed on Mar. 26, 1996.

BACKGROUND OF THE INVENTION

1. Field of the invention

The present invention relates to a pair of swimming goggles, more particularly to a pair of swimming goggles which has lens frames, gasket units and a nose bridge that are formed integrally and which can effectively guard against deformation of the lens frames when the swimming goggles are in use.

2. Description of the Related Art

A known pair of swimming goggles include two lens frames, two lens units, a nose bridge, two gasket units and a head strap unit. The lens frames, the nose bridge and the gasket units are formed integrally. Each of the lens frames is generally annular in shape and has an inner periphery that defines a lens retaining space, an outer periphery that has a bridge connecting portion and a strap connecting portion opposite to the bridge connecting portion, and front and rear parts. Each of the lens frames is formed with an inclined stop member which extends outwardly and rearwardly from the strap connecting portion thereof. Each of the stop members and the strap connecting portion of a corresponding one of the lens frames cooperatively define an engaging hole therebetween. The two lens units are mounted respectively on the front parts of the lens frames in the lens retaining spaces of the latter. The nose bridge, which interconnects the bridge connecting portions of the lens frames, is generally U-shaped in cross section and has a concave rear surface, a convex front surface and two terminal end portions that extend integrally and respectively to the bridge connecting portions of the lens frames. The nose bridge further has an upper end portion, a lower end portion and an intermediate portion which extends between the terminal end portions and which is located between the upper and lower end portions. The intermediate portion is thicker than the upper and lower end portions. The gasket units are provided respectively on the rear parts of the lens frames. The head strap unit interconnects the strap connecting portions of the lens frames and includes an elongated strap member and two engaging members provided at opposite end portions of the strap member.

The lens frames, the nose bridge and the gasket units are made from a semi-rigid material with an appropriate flexibility, thereby permitting integral fabrication of the same so as to reduce the manufacturing time and the cost of manufacture and so as to increase the production rate. In addition, the stop members on the lens frames and the engaging members on the head strap unit help preventing deformation of the lens frames when the swimming goggles are in use, thereby preventing the formation of a gap between each of the lens frames and the corresponding one of the lens units to prevent correspondingly the seepage of water.

One of the drawbacks of the aforementioned swimming goggles resides in that the stop members on the lens frames and the engaging members on the head strap unit reduce the space allocated for the lens units, thereby resulting in smaller lens units which, in turn, leads to a smaller viewing angle of about 150° when the swimming goggles are in use. The smaller viewing angle does not comply with standards currently employed in most countries, which require a viewing angle of about 180°.

Another drawback of the aforementioned swimming goggles resides in that deformation of the lens frames may still occur since the pulling forces that are exerted on the lens frames by the head strap unit when the goggles are in use are transmitted directly onto the nose bridge. Moreover, the nose bridge cannot easily adapt to the size of the head of the user.

SUMMARY OF THE INVENTION

Therefore, the object of the present invention is to provide a pair of swimming goggles that can overcome the drawbacks of the aforementioned prior art.

More specifically, the main object of the present invention is to provide a pair of swimming goggles which have lens frames, gasket units and a nose bridge that are formed integrally and which employs a novel connection between the lens frames and a head strap to maximize the space allocated for the lens units, thereby resulting in a larger viewing angle which conforms with the international standard.

Another object of the present invention is to provide a pair of swimming goggles, the nose bridge of which can easily adapt to the size of the head of the user without resulting in deformation of the lens frames.

According to one aspect of the present invention, a pair of swimming goggles include two lens frames, two lens units, a nose bridge, two gasket units and a head strap. Each of the lens frames has an inner periphery that defines a lens retaining space, and an outer periphery that has bridge and strap connecting portions. Each of the lens units is mounted on a front part of a respective one of the lens frames in the lens retaining space of the latter. The nose bridge has two terminal end portions connected to the bridge connecting portions of the respective lens frames. The gasket units are provided on rear parts of the respective lens frames. The head strap has two ends connected respectively to the lens frames. The lens frames, the nose bridge and the gasket units are formed integrally. The strap connecting portion of each of the lens frames has an integrally formed elongated extension which is connected to one of the ends of the head strap and which is formed with at least one depression to enhance stretchability of the extension, thereby reducing the amount of pulling force that is transmitted to the lens frames by the head strap when the swimming goggles are in use.

According to another aspect of the present invention, a pair of swimming goggles include two lens frames, two lens units, a nose bridge, two gasket units and a head strap. Each of the lens frames has an inner periphery that defines a lens retaining space, and an outer periphery that has bridge and strap connecting portions. Each of the lens units is mounted on a front part of a respective one of the lens frames in the lens retaining space of the latter. The nose bridge has two terminal end portions connected to the bridge connecting portions of the respective lens frames. The gasket units are provided on rear parts of the respective lens frames. The head strap has two ends connected respectively to the lens frames. The lens frames, the nose bridge and the gasket units are formed integrally. Each of the terminal end portions of the nose bridge is formed with a number of slits that are transverse to a lengthwise direction of the nose bridge, thereby enhancing stretchability of the nose bridge to enable the latter to adapt easily to the size of the head of the user.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
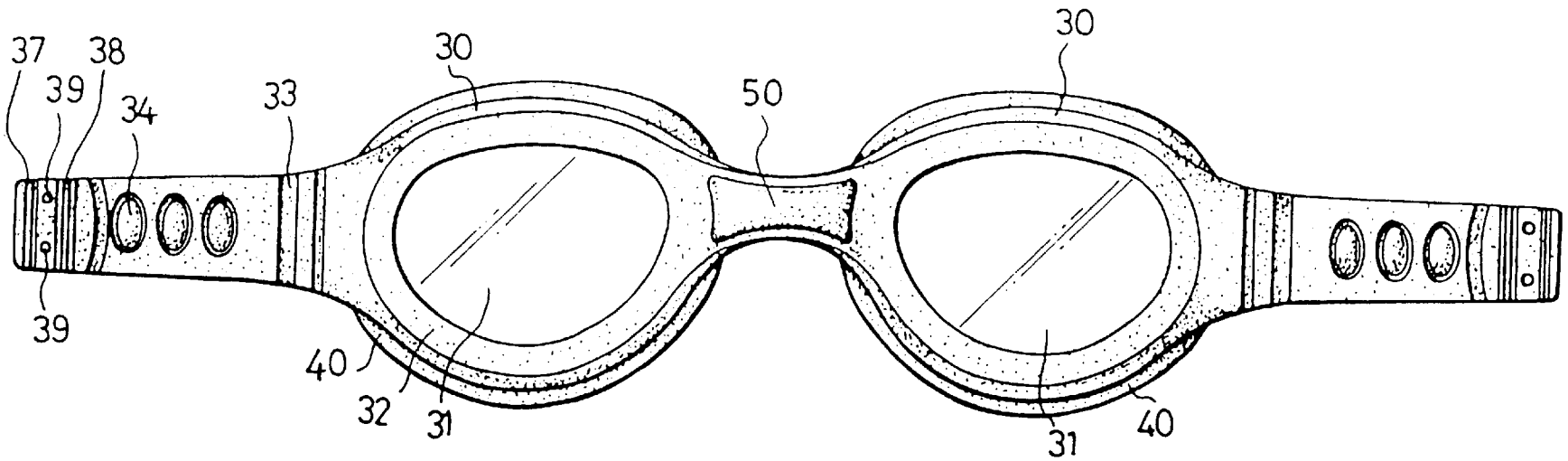
FIG. 1 is a schematic view which illustrates the first preferred embodiment of a pair of swimming goggles according to the present invention.
Figure 2:
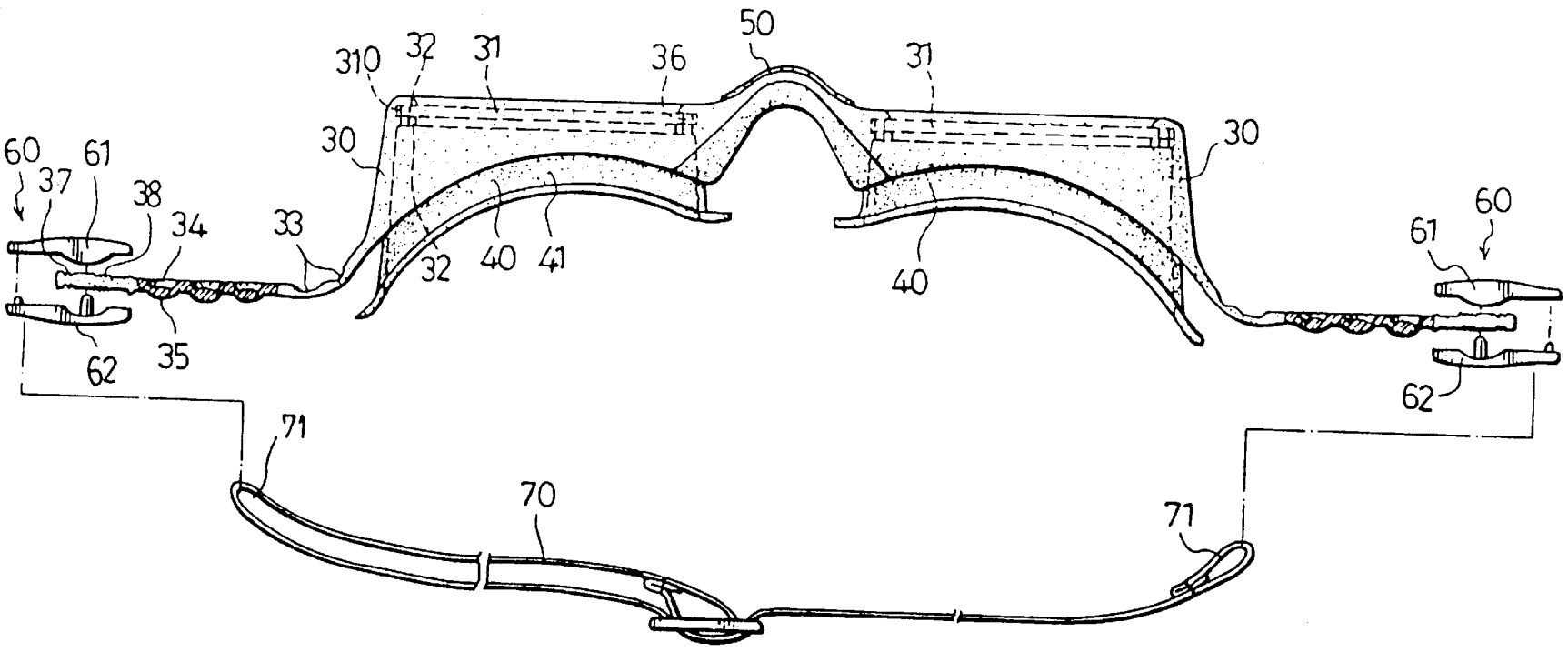
FIG. 2 is a schematic exploded view of the first preferred embodiment.

Referring to FIGS. 1 and 2, the first preferred embodiment of a pair of swimming goggles according to the present invention is shown to comprise two lens frames 30, two lens units 31, a nose bridge 50, two gasket units 40 and a head strap 70. The lens frames 30, the nose bridge 50 and the gasket units 40 are formed integrally.

Each of the lens frames 30 is generally oval-shaped and has an inner periphery that defines a lens retaining space, an outer periphery that has a bridge connecting portion and a strap connecting portion opposite to the bridge connecting portion, and front and rear parts. The inner periphery of each of the lens frames 30 has a pair of spaced annular flanges 32 which extend inwardly therefrom and which cooperatively define an annular retaining groove therebetween.

To conform with the lens frames 30, each of the lens units 31 is generally oval-shaped and has a peripheral portion that is mounted on the front part of a corresponding one of the lens frames 30 in the lens retaining space of the latter by inserting the peripheral portion in the retaining groove. As best shown in FIG. 2, the peripheral portion of each of the lens units 31 is formed with a plurality of through holes 310. Each of the lens frames 30 further has a plurality of engaging pins 36 which are formed integrally between the annular flanges 32 and which extend through the through holes of the corresponding one of the lens units 31, thereby mounting securely the latter thereto.

Figure 3:
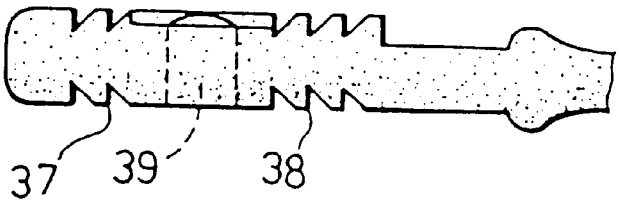
FIG. 3 is a schematic view of a section of an elongated extension on a lens frame of the first preferred embodiment.
Figure 4:
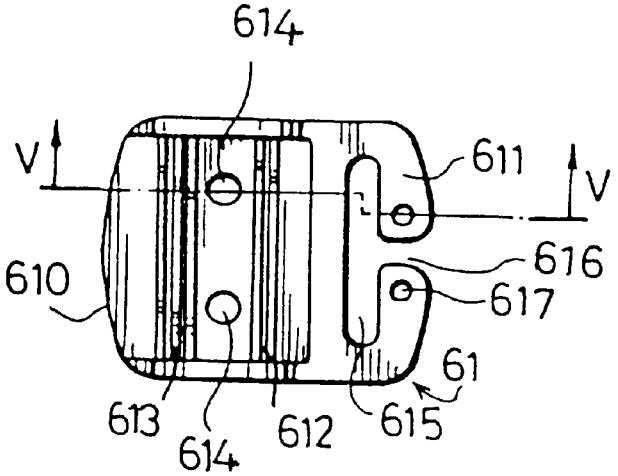
FIG. 4 is a schematic view of a first connector unit of the first preferred embodiment.
Figure 5:
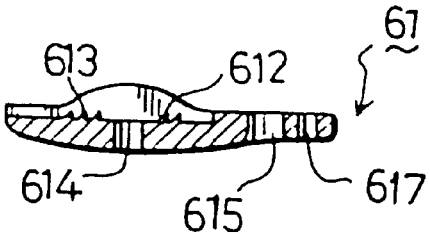
FIG. 5 is a sectional view of the first connector unit, taken along line V—V in FIG. 4.
Figure 6:
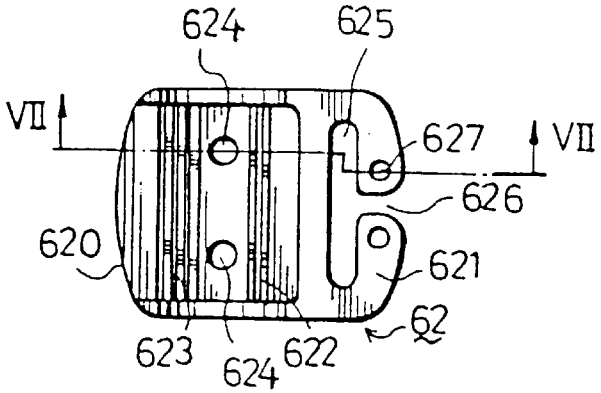
FIG. 6 is a schematic view of a second connector unit of the first embodiment.
Figure 7:
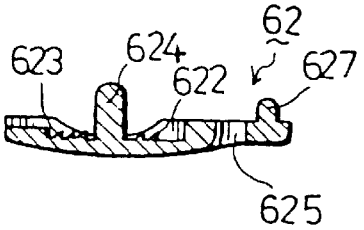
FIG. 7 is a sectional view of the second connector unit, taken along line VII—VII in FIG. 6.

The strap connecting portion of each of the lens frames 30 has an integrally formed elongated extension. The extension has one side formed with depressions to enhance stretchability thereof, thereby reducing the amount of pulling force that is transmitted to the lens frame 30 by the head strap 70 when the swimming goggles are in use. Preferably, the extension has a first section which extends from the corresponding one of the lens frames 30, an intermediate second section which extends from the first section, and a third section which extends from the second section. The depressions in the extension include a number of grooves 33 that are formed in the first section, and a number of cavities 34 that are formed in the second section. In this embodiment, two grooves 33 extend in a direction transverse to the length of the first section, while three oval-shaped cavities 34 have major axes that lie in a direction transverse to the length of the second section. Each of the cavities 34 has a rounded bottom 35. As shown in FIG. 3, the third section of the extension has first and second serrated segments 37, 38 and a pair of through holes 39 (only one is shown in FIG. 3) between the serrated segments 37, 38.

Referring to FIGS. 2–7, two strap connectors 60 are employed to connect two ends of the head strap 70 to the third sections of the extensions. In this embodiment, each of the strap connectors 60 includes complementary first and second connector units 61, 62.

The first connector unit 61 is a plate-like member having a clamping portion 610 and a strap engaging portion 611. The clamping portion 610 of the first connector unit 61 has an inner face formed with two sets of teeth 612, 613 which engage the serrated segments 37, 38 of the third section of the corresponding extension. The clamping portion 610 of the first connector unit 61 is further formed with a pair of retaining holes 614 which are aligned with the through holes 39 in the third section of the corresponding extension. The strap engaging portion 611 of the first connector unit 61 is generally C-shaped and is formed with a T-shaped opening that includes an elongated slot 615 which is transverse to a longitudinal axis of the first connector unit 61 and a notch 616 which lies on the longitudinal axis of the first connector unit 61 and which serves as an access into the slot 615. The strap engaging portion 611 of the first connector unit 61 is further formed with a pair of pin holes 617 on two sides of the notch 616.

The second connector unit 62 is also a plate-like member having clamping and strap engaging portions 620, 621. The clamping portion 620 has an inner face formed with two sets of teeth 622, 623 which engage the serrated segments 37, 38 of the third section of the corresponding extension. The clamping portion 620 is further formed with a pair of retaining projections 624 which extend through the through holes 39 in the third section of the corresponding extension, and which engage the retaining holes 614 in the first connector unit 61. The strap engaging portion 621 of the second connector unit 621 is also generally C-shaped and is formed with a T-shaped opening that includes an elongated slot 625 which is transverse to a longitudinal axis of the second connector unit 62 and a notch 626 which lies on the longitudinal axis of the second connector unit 62 and which serves as an access into the slot 625. The strap engaging portion 621 is further formed with a pair of mounting pins 627 which engage the pin holes 617 in the first connector unit 61.

Referring once more to FIGS. 1 and 2, the nose bridge 50 interconnects the bridge connecting portions of the lens frames 30. The nose bridge 50 is generally U-shaped in cross section and has a concave rear surface, a convex front surface and two terminal end portions that extend integrally and respectively to the bridge connecting portions of the lens frames 30. The nose bridge 50 further has an upper end portion, a lower end portion and an intermediate portion which extends between the terminal end portions and which is located between the upper and lower end portions. The intermediate portion is thicker than the upper and lower end portions.

The gasket units 40 are provided respectively on the rear parts of the lens frames 30. Each of the gasket units 40 is generally J-shaped in cross section and has a longer end portion and a shorter end portion which extends integrally from the rear part of the respective one of the lens frames 30 such that the longer end portion extends around the respective one of the lens frames 30. The longer and the shorter end portions of each of the gasket units 40 cooperatively define an annular groove 41 therebetween.

The head strap 70 is a length-adjustable elastic strap with two looped ends 71 each of which is inserted into the T-shaped openings in the strap engaging portions 611, 621 of the first and second connector units 61, 62 via the notches 616, 626 so as to be hooked thereon.

During assembly, the strap connectors 60 are simply installed on the extensions of the lens frames 30 in the aforementioned manner, and the looped ends 71 of the head strap 70 are hooked onto the strap connectors 60. The swimming goggles are ready for use at this time.

Figure 8:
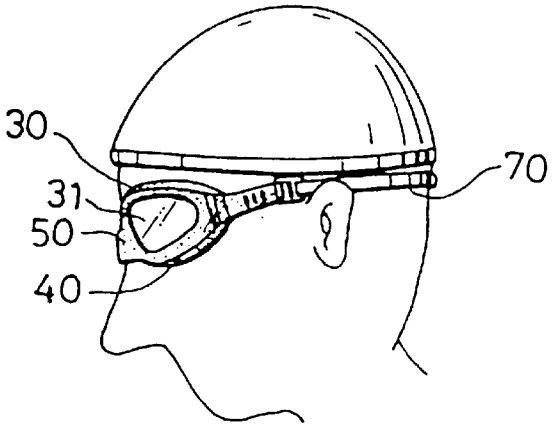
FIG. 8 illustrates the first preferred embodiment when in use.

Referring now to FIG. 8, in use, each of the lens frames 30 is disposed around a corresponding one of the user's eyes such that the face contacting surface of each of the gasket units 40 is in contact with the user's face. Then, the lens frames 30 are pressed toward the user's face so as to expel the excess air in the grooves 41 of the gasket units 40. The gasket units 40 thus act as suction caps which prevent the formation of a gap between the user's face and the face contacting surface of the gasket units 40. Afterwards, the head strap 70 is worn around the user's head so as to retain the swimming goggles properly thereon. The retaining forces which are produced by the head strap 70 for retaining the swimming goggles on the user's head can be varied by adjusting the length of the head strap 70 between the extensions of the lens frames 30.

The lens frames 30, the nose bridge 50 and the gasket units 40 are made of a semi-rigid material with an appropriate flexibility, thereby permitting integral fabrication of the same so as to reduce the manufacturing time and the cost of manufacture and so as to increase the production rate. In addition, the construction of the extensions of the lens frames 30 reduces the amount of pulling force that is transmitted to the lens frames 30, thereby minimizing the risk of deformation of the lens frames 30 when the swimming goggles are in use to prevent the formation of a gap between each of the lens frames 30 and the corresponding one of the lens units 31 to prevent consequently the seepage of water. Moreover, unlike the aforementioned known swimming goggles, no stop members and engaging members are in use, thus maximizing the space allocated for the lens units 31 to result in a larger viewing angle which conforms with the international standards.

FIGS. 9–14 illustrate the second preferred embodiment of a pair of swimming goggles according to the present invention. The second embodiment is generally similar to the first preferred embodiment, the main difference residing in the constructions of the nose bridge 50*a*, the extensions on the lens frames 30*a*, and the strap connectors 60*a*.

As shown in FIGS. 9–12, each of the terminal end portions of the nose bridge 50*a* is formed with a number of slits 51 that are transverse to a lengthwise direction of the nose bridge 50*a*. The slits 51 enhance stretchability of the nose bridge 50*a* to enable the latter to adapt easily to the size of the user's head without resulting in deformation of the lens frames30*a*. Each of the slits 51 has opposite shallower ends 511 to reinforce the nose bridge 50*a* so as to avoid tearing of the same at the slits 51.

Figure 9:
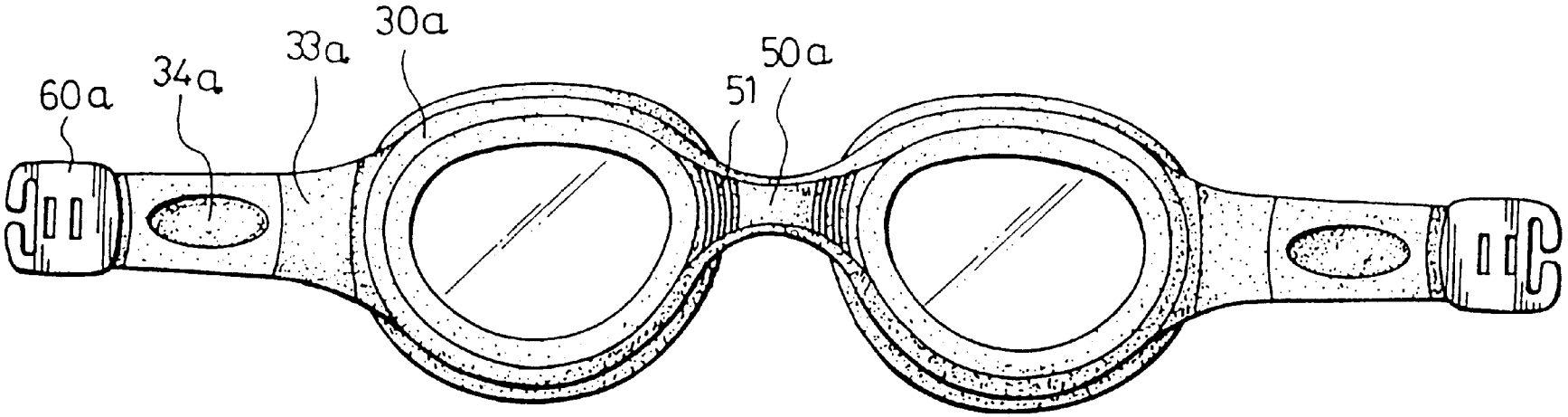
FIG. 9 is a schematic view which illustrates the second preferred embodiment of a pair of swimming goggles according to the present invention.
Figure 10:
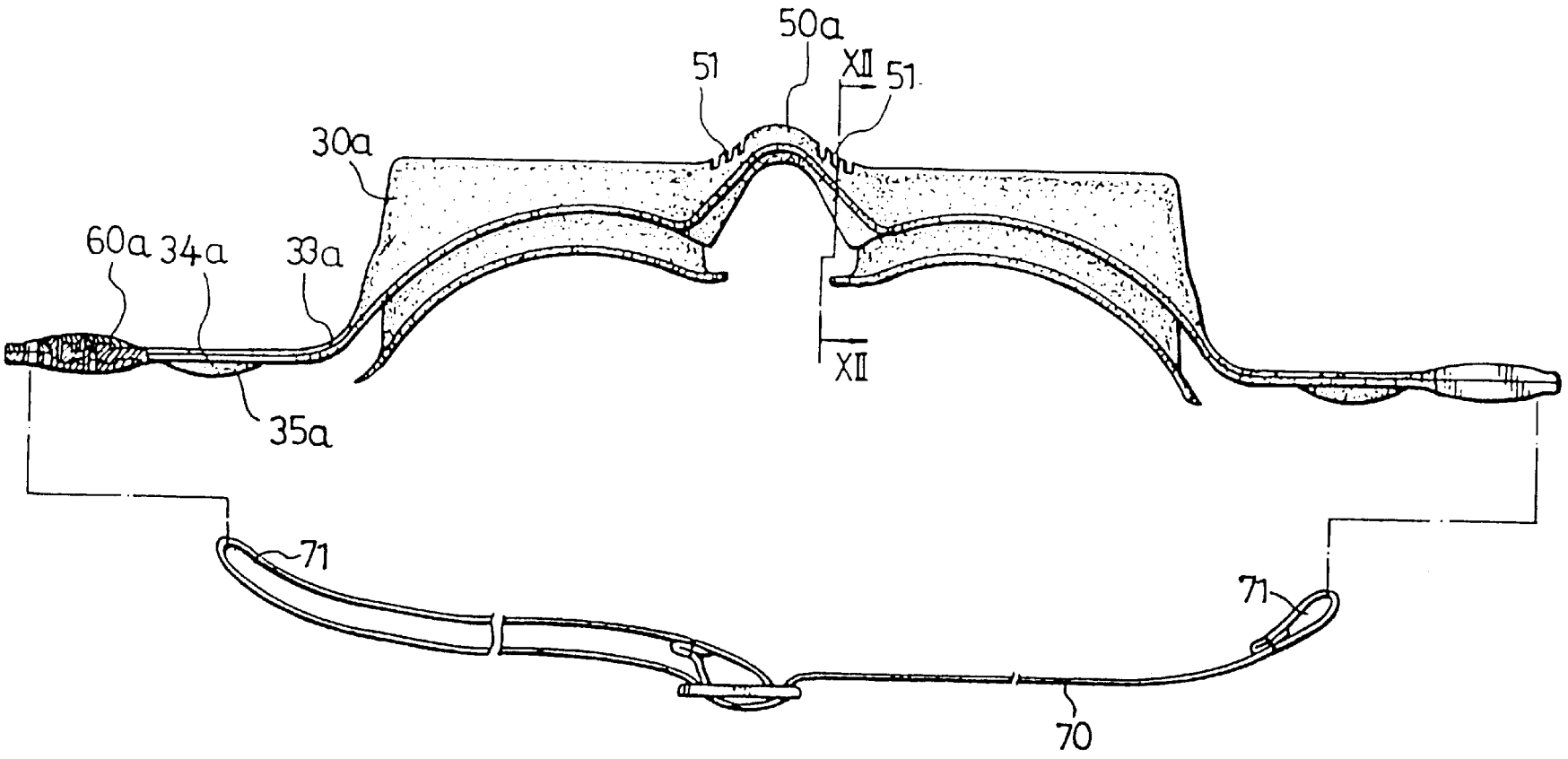
FIG. 10 is a schematic top view of the second preferred embodiment.
Figure 11:
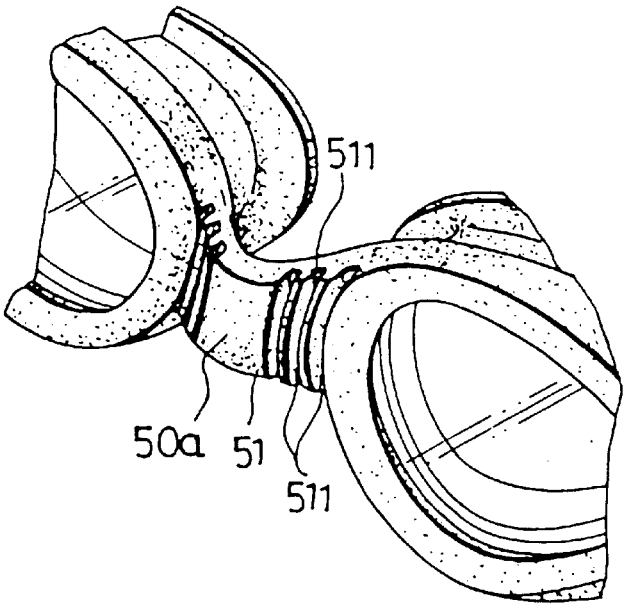
FIG. 11 is a fragmentary perspective view of a nose bridge of the second preferred embodiment.
Figure 12:
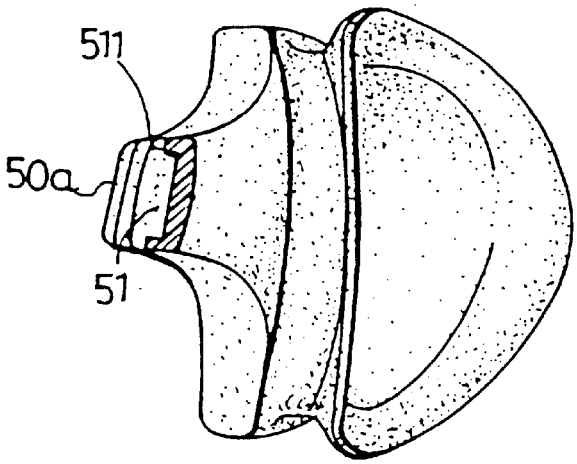
FIG. 12 is a sectional view of the second preferred embodiment taken along line XII—XII in FIG. 10.
Figure 13:
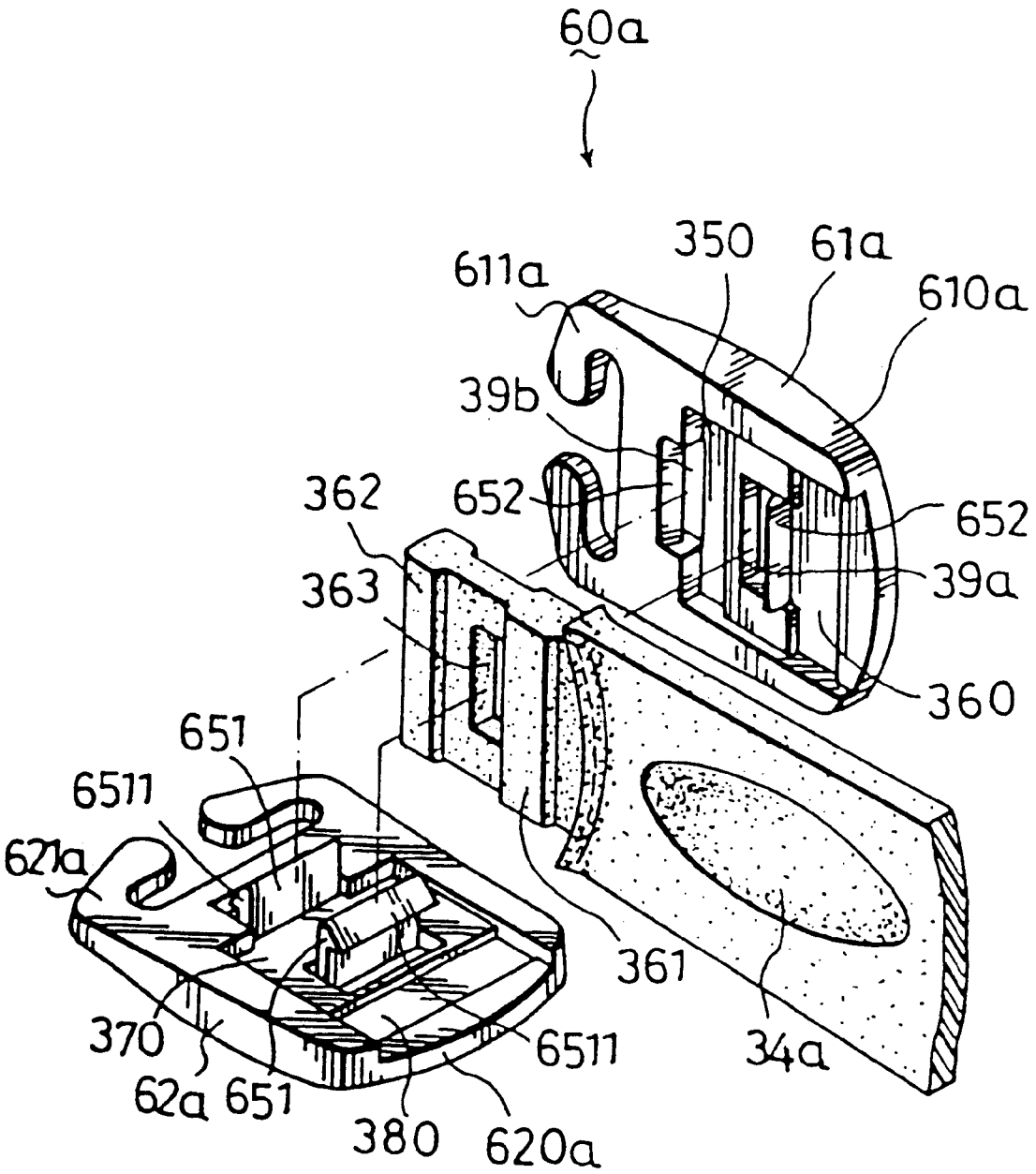
FIG. 13 is a perspective view illustrating a strap connector and an elongated extension on a lens frame of the second preferred embodiment.
Figure 14:
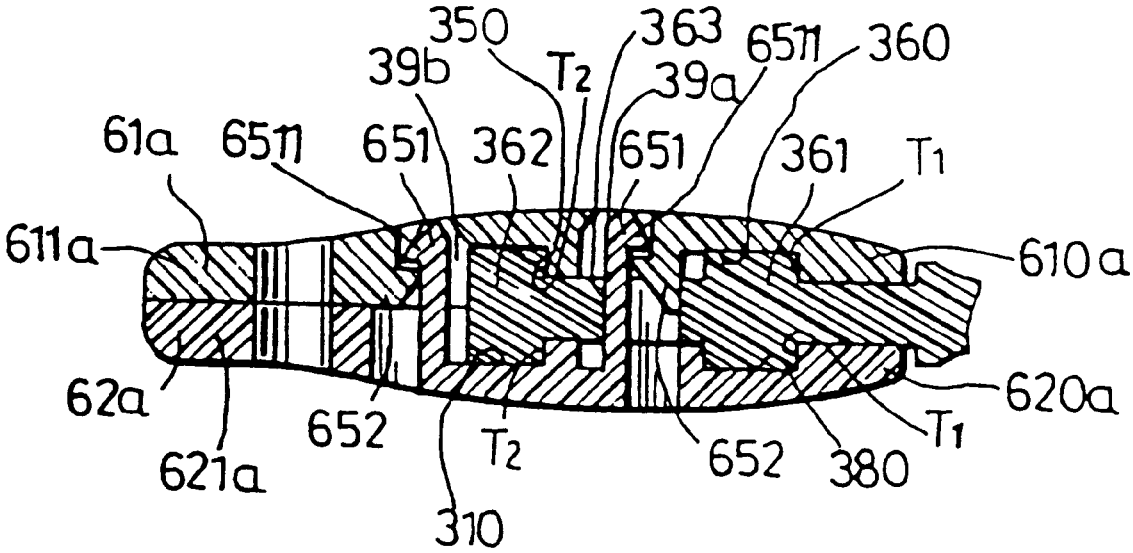
FIG. 14 is a sectional view which illustrates the connection between the strap connector and the elongated extension in FIG. 13

Like the previous embodiment, the extension on each of the lens frames 30*a* also has one side formed with depressions to enhance stretchability of the extension. As shown in FIGS. 9 and 10, the first section of the extension is formed with a concavity 33*a*, while the second section of the extension is formed with an oval-shaped cavity 34*a* which has a major axis that lies along a lengthwise direction of the second section. The cavity 34*a* has a rounded bottom 35*a*, as shown in FIG. 10. Referring to FIGS. 13 and 14, the third section of the extension has first and second enlarged segments 361, 362 and a through hole 363 between the enlarged segments 361, 362.

Each of the strap connectors 60*a* includes complementary first and second connector units 61*a*, 62*a*. As with the previous embodiment, the first and second connector units 61*a*, 62*a* are plate-like members having clamping and strap engaging portions 610*a*. 611*a* and 620*a*, 621*a*. The clamping portions 610*a*, 620*a* of each of the first and second connector units 61*a*, 62*a* has an inner side formed with two retaining grooves 350, 360 and 370, 380 which engage the enlarged segments 361, 362 of the third section of the corresponding extension. Each retaining groove 350, 360, 370, 380 has a wall portion T1, T2 which abuts against the respective one of the enlarged segments 361, 362 to arrest movement of the strap connector 50*a* away from the respective extension. The clamping portion 610*a* of the first connector unit 61*a* is formed with two retaining holes 39*a*, 39*b* disposed adjacent to the retaining grooves 350, 360, respectively. Each retaining hole 39*a*, 39*b* extends in a transverse direction of the extension. The clamping portion 620*a* of the second connector unit 62*a* is formed with a pair of retaining projections 651 which extend respectively into the retaining holes 39*a*, 39*b*. Each of the retaining projections 651 has a hooked end portion 6511. Each of the retaining holes 39*a*, 39*b* is formed with a barb projection 652 which engages the hooked end portion 6511 of the respective one of the retaining projections 651. One of the retaining projections 651 extends through the through hole 363 in the third section of the corresponding extension.

During assembly, the enlarged segments 361, 362 of the third section of the extension are disposed respectively in the retaining grooves 370, 380 of the second connector unit 62*a*. One of the retaining projections 651 of the second connector unit 62*a* extends through the through hole 363 in the third section of the extension at this time. The first connector unit 61*a* is then provided on the third section of the extension such that the retaining grooves 350, 360 thereof engage the enlarged segments 361, 362 and such that the retaining projections 651 of the second connector unit 62*a* extend into the retaining holes 39*a*, 39*b*, respectively. The barb projections 652 in the retaining holes 39*a*, 39*b* engage the hooked end portions 6511 of the retaining projections 651 at this time to interconnect the first and the second connector units 61*a*, 62*a*.

As mentioned beforehand, the wall portions T1, T2 of the retaining grooves 35, 360, 370, 380 abut against the enlarged segments 361, 362 to guard against movement of the strap connector 60*a* away from the respective extension. In addition, one of the retaining projections 651 extends through the through hole 363 in the extension to reinforce the connection between the strap connector 60*a* and the extension. As with the previous embodiment, the strap engaging portion 611*a,* 621*a* of each of the first and second connector units 61*a*, 62*a* is generally C-shaped so as to engage one of the looped ends 71 of the head strap 70 in the aforementioned manner.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A pair of swimming goggles comprising:

two lens frames, each of which has an inner periphery that defines a lens retaining space, an outer periphery that has a bridge connecting portion, a strap connecting portion opposite to the bridge connecting portion, and front and rear parts, two lens units, each of which is mounted on a front part of a respective one of the lens frames in the lens retaining space of the respective one of the lens frames, a nose bridge having two terminal end portions, each of which is connected to the bridge connecting portion of a respective one of the lens frames, two gasket units each provided on the rear part of a respective one of the lens frame, and a head strap having two ends connected respectively to the lens frames, the lens frames, the nose bridge, and the gasket units being formed integrally; and wherein each of the terminal end portions of the nose bridge is formed with a number of slits that are transverse to a lengthwise direction of the nose bridge, thereby enhancing stretchability of the nose bridge, each of the slits has opposite shallower ends.

* * * * *